US007299567B2

(12) United States Patent
Berend et al.

(10) Patent No.: US 7,299,567 B2
(45) Date of Patent: Nov. 27, 2007

(54) ARTICLE OF FOOTWEAR WITH SOLE PLATE

(75) Inventors: Thomas Berend, Beaverton, OR (US); Anthony P. Daversa, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 564 days.

(21) Appl. No.: 10/870,674

(22) Filed: Jun. 17, 2004

(65) Prior Publication Data

US 2005/0278980 A1 Dec. 22, 2005

(51) Int. Cl.
*A43B 13/42* (2006.01)
*A43B 13/12* (2006.01)

(52) U.S. Cl. ..... 36/88; 36/107; 36/108; 36/69; 36/30 R; 36/91; 36/92

(58) Field of Classification Search ..... 36/114, 36/88, 142–144, 91, 92, 107, 108, 68, 69, 36/30 R
See application file for complete search history.

(56) References Cited

U.S. PATENT DOCUMENTS

| | | | | |
|---|---|---|---|---|
| 1,592,692 | A | 7/1926 | Hackett | |
| 2,138,823 | A | 12/1938 | Werkman | |
| 3,586,003 | A * | 6/1971 | Baker | 36/145 |
| 4,402,146 | A | 9/1983 | Parracho et al. | 36/129 |
| 4,506,460 | A * | 3/1985 | Rudy | 36/127 |
| 4,594,798 | A * | 6/1986 | Autry et al. | 36/68 |
| 4,766,679 | A * | 8/1988 | Bender | 36/30 R |
| 4,813,159 | A * | 3/1989 | Weiss | 36/43 |
| 4,866,861 | A * | 9/1989 | Noone | 36/127 |
| 4,947,560 | A | 8/1990 | Fuerst et al. | 36/88 |
| 5,024,007 | A * | 6/1991 | DuFour | 36/127 |
| 5,152,082 | A * | 10/1992 | Culpepper | 36/89 |
| 5,915,820 | A | 6/1999 | Kraeuter et al. | 36/114 |
| 6,119,373 | A * | 9/2000 | Gebhard et al. | 36/114 |
| 6,199,303 | B1 | 3/2001 | Luthi et al. | 36/31 |
| 6,321,469 | B1 * | 11/2001 | Cretinon | 36/102 |
| 6,401,366 | B2 | 6/2002 | Foxen et al. | |
| 6,438,870 | B2 * | 8/2002 | Nasako et al. | 36/28 |
| 6,438,873 | B1 | 8/2002 | Gebhard et al. | 36/114 |
| 6,477,791 | B2 | 11/2002 | Luthi et al. | 36/31 |

(Continued)

FOREIGN PATENT DOCUMENTS

| | | |
|---|---|---|
| DE | 3643057 | 6/1988 |

(Continued)

OTHER PUBLICATIONS

International Search Report for PCT/US2005/021519.

*Primary Examiner*—Marie Patterson
(74) *Attorney, Agent, or Firm*—Banner & Witcoff, Ltd.

(57) ABSTRACT

An article of footwear includes a sole assembly and an upper secured to the sole assembly. A sole plate is positioned between the upper and the sole assembly. The sole plate includes a midfoot member comprising a medial member having a base plate and at least one medial pillar extending upwardly from a medial edge of the base plate; with the base plate having a substantially planar finger extending forwardly and configured to extend under a foot of a user; and a lateral member having at least one lateral pillar extending upwardly from a lateral edge thereof. A forefoot member has at least one finger extending upwardly along an exterior surface of the upper.

35 Claims, 3 Drawing Sheets

U.S. PATENT DOCUMENTS

| | | | | |
|---|---|---|---|---|
| 6,497,058 | B2 * | 12/2002 | Dietrich et al. | 36/69 |
| 6,502,330 | B1 * | 1/2003 | David et al. | 36/88 |
| 6,625,905 | B2 * | 9/2003 | Kita | 36/30 R |
| 7,082,702 | B2 * | 8/2006 | Cretinon | 36/88 |
| 2004/0111920 | A1 * | 6/2004 | Cretinon | 36/30 R |
| 2005/0246922 | A1 * | 11/2005 | Gibert et al. | 36/27 |

FOREIGN PATENT DOCUMENTS

| | | |
|---|---|---|
| EP | 1 002 437 A1 | 5/2000 |
| GB | 2 243 530 A | 11/1991 |
| JP | 43-3602 | 2/1943 |
| JP | 48-66748-01 | 11/1946 |
| JP | 48-108850-01 | 3/1947 |
| JP | 51-147641 | 5/1956 |
| JP | 25749 | 5/1956 |
| JP | 63-117306 | 7/1988 |

* cited by examiner

ARTICLE OF FOOTWEAR WITH SOLE PLATE

FIELD OF THE INVENTION

This invention relates generally to an article of footwear with a sole plate, and, in particular, to an article of footwear with a sole plate having improved stability and resistance to wear.

BACKGROUND OF THE INVENTION

During certain athletic activities, such as tennis, a user's footwear can undergo great strain while moving laterally. Known athletic footwear have incorporated different elements to help support the user's foot during such cutting motion. For example, a shank plate has been provided in the medial arch region, and fingers or pillars have been provided on the lateral side. These components are designed to provide support and leverage It is an object of the present invention to provide an article of footwear with a sole plate that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide an article of footwear with a sole plate having improved lateral stability and support, and improved abrasion resistance in a forefoot portion of the footwear.

In accordance with a first aspect, an article of footwear includes a sole assembly and an upper secured to the sole assembly. A sole plate is positioned between the upper and the sole assembly. The sole plate includes a midfoot member comprising a medial member having a base plate and at least one medial pillar extending upwardly from a medial edge of the base plate; with the base plate having a substantially planar finger extending forwardly and configured to extend under a foot of a user; and a lateral member having at least one lateral pillar extending upwardly from a lateral edge thereof. A forefoot member has at least one finger extending upwardly along an exterior surface of the upper.

In accordance with another aspect, an article of footwear includes an upper, a midsole secured to the upper, and an outsole secured to the midsole. A sole plate is positioned between the midsole and the outsole, and includes a midfoot member. The midfoot member includes a medial member having a base plate and an arch portion extending upwardly from the base plate. The base plate has a substantially planar finger extending forwardly and configured to extend to a point just rearwardly of the first and second metatarsal heads of a foot of a user. A lateral member has a pair of pillars extending upwardly and forwardly along a lateral edge of a forefoot portion of the lateral member and a pillar extending upwardly and rearwardly along a lateral edge of a heel portion of the lateral member. A forefoot member has three fingers extending upwardly from a medial edge thereof and a finger extending upwardly from a front edge thereof.

In accordance with a further aspect, an article of footwear includes an upper and a midsole secured to the upper. A bottom surface of the midsole includes a forefoot recess, a midfoot recess and a central recess, the central recess being formed within the midfoot recess. An outsole is secured to the midsole. A sole plate is positioned between the midsole and the outsole, and includes a midfoot member. The midfoot member is received by the midfoot recess and includes a medial member having a base plate and an arch portion extending upwardly from the base plate. The base plate has a substantially planar finger extending forwardly and configured to extend to a point just rearwardly of the first and second metatarsal heads of a foot of a user. A thickened portion is formed along a lateral edge of the medial member, and a flange extends inwardly from the thickened portion. A lateral member has a pair of pillars extending upwardly and forwardly along a lateral edge of a forefoot portion of the lateral member. A pillar extends upwardly and rearwardly along a lateral edge of a heel portion of the lateral member. A thickened portion is formed along a medial edge of the lateral member. A flange extends inwardly from the thickened portion, and the flange of the lateral member is configured to mate with the flange of the medial member. The thickened portion of the lateral member and the thickened portion of the medial member are received by the central recess. A forefoot member has three fingers extending upwardly along a medial exterior surface of the upper and a finger extending upwardly along a front exterior surface of the upper.

Substantial advantage is achieved by providing an article of footwear with a sole plate. In particular, such an article of footwear provides increased resistance to abrasion, and greater stability and motion control. This is highly advantageous since it helps reduce fatigue, aid forward momentum, and provide durability and extended life for the footwear.

These and additional features and advantages of the invention disclosed here will be further understood from the following detailed disclosure of certain preferred embodiments.

Figure 1:
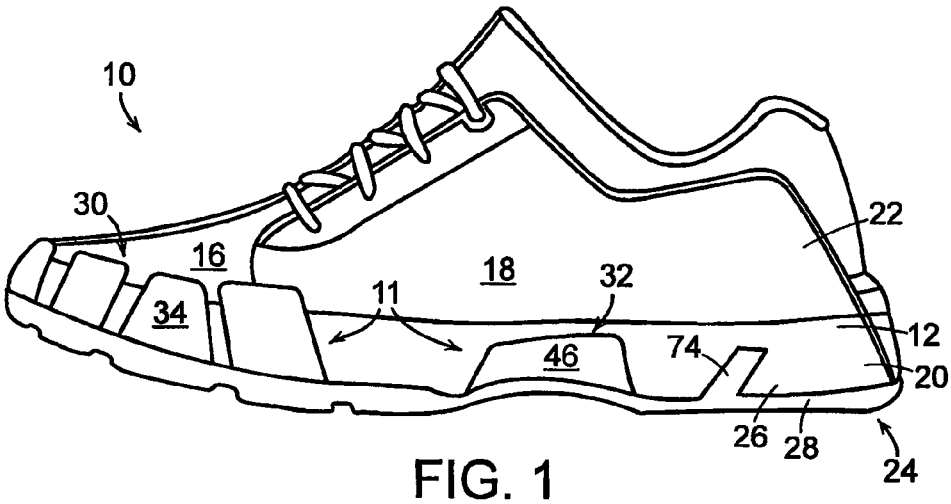
FIG. 1 is a medial side elevation view of an article of footwear in accordance with a preferred embodiment of the present invention.

The figures referred to above are not drawn necessarily to scale and should be understood to provide a representation of the invention, illustrative of the principles involved. Some features of the sole plate for an article of footwear depicted in the drawings have been enlarged or distorted relative to others to facilitate explanation and understanding. The same reference numbers are used in the drawings for similar or identical components and features shown in various alternative embodiments. Sole plates for articles of footwear as disclosed herein, would have configurations and components determined, in part, by the intended application and environment in which they are used.

DETAILED DESCRIPTION OF CERTAIN PREFERRED EMBODIMENTS

Figure 2:
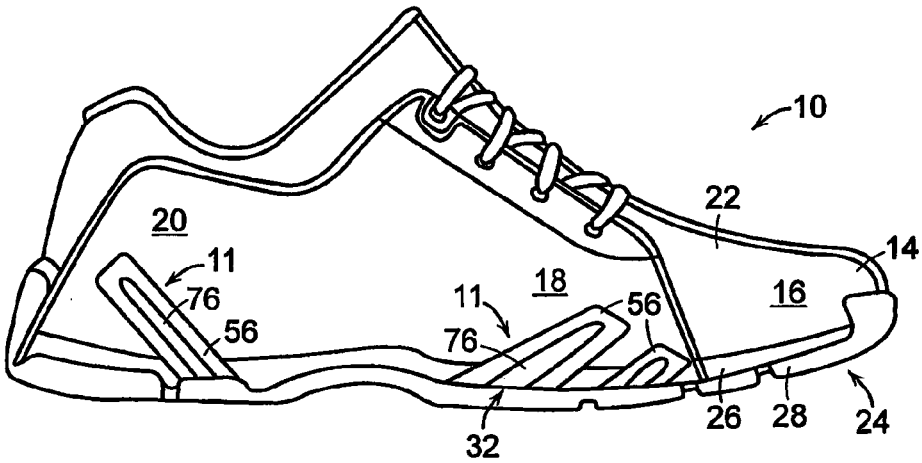
FIG. 2 is a lateral side elevation view of the article of footwear of FIG. 1.

The present invention may be embodied in various forms. A preferred embodiment of an article of footwear 10 incorporating a sole plate 11 is shown in FIGS. 1-2. Article of footwear 10 has a medial, or inner, side 12 and a lateral, or outer, side 14. For purposes of general reference, footwear 10 may be divided into three general portions: a forefoot portion 16, a midfoot portion 18, and a heel portion 20. Portions 16, 18, and 20 are not intended to demarcate precise areas of footwear 10. Rather, portions 16, 18, and 20 are intended to represent general areas of footwear 10 that provide a frame of reference during the following discussion.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the right as seen in FIG. 1. Naturally, forwardly is toward forefoot portion 16, that is, to the left as seen in FIG. 1, and downwardly is toward the bottom of the page as seen in FIG. 1. Inwardly is toward the center of footwear 10, and outwardly is toward the outer peripheral edge of footwear 10.

Footwear 10 includes an upper 22, and a sole assembly 24 secured to upper 22. Sole assembly 24 may be secured to upper 22 by an adhesive, or any other suitable fastening means. Upper 22 receives and comfortably secures footwear 10 to a foot of a wearer. Upper 22 may be formed of leather, synthetic materials, or a combination thereof. Suitable materials for upper 22 will become readily apparent to those skilled in the art, given the benefit of this disclosure.

Sole assembly 24 is generally disposed between the foot of the wearer and the ground. As with conventional articles of athletic footwear, sole assembly 24 includes an insole (not shown) located within upper 22, a midsole 26, and an outsole 28. Midsole 26 is attached to upper 22 and functions as the primary shock-attenuating and energy-absorbing component of footwear 10. Outsole 28 is attached to the lower surface of midsole 26 and forms the ground-contacting element of footwear 10. Outsole 28 is usually fashioned from a durable, wear resistant material that includes texturing to improve traction. Suitable materials for the insole, midsole 26 and outsole 28 will become readily apparent to those skilled in the art, given the benefit of this disclosure.

Figure 3:
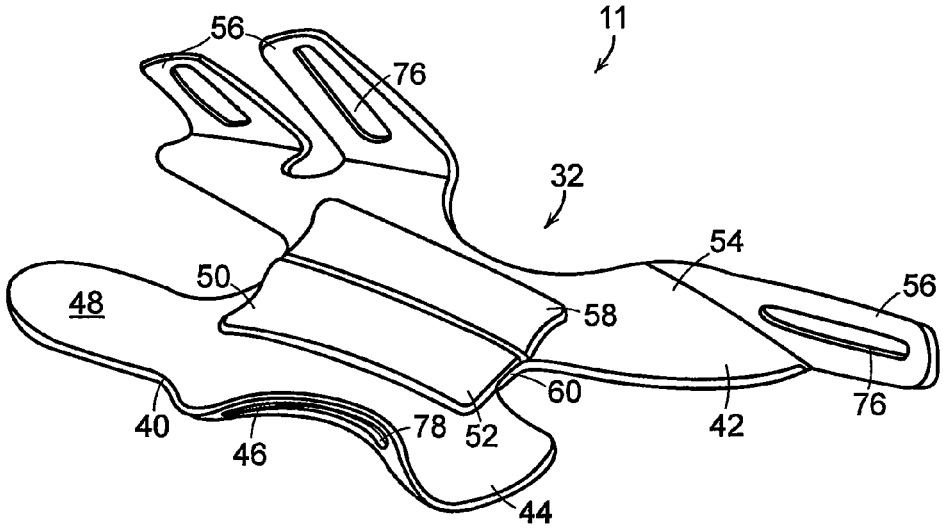
FIG. 3 is a perspective view of a midfoot member of a sole plate of the article of footwear of FIG. 1.

In a preferred embodiment, sole plate 11 is disposed between midsole 26 and outsole 28. Sole plate 11, which can be seen more clearly in FIGS. 3-4, includes a forefoot member 30 and a midfoot member 32. Forefoot member 30 extends along medial side 12 of forefoot portion 16 of footwear 10. Forefoot member 30 includes a base plate 33 and a plurality of fingers 34 extending upwardly from base plate 33 along an outer edge of base plate 33. In the illustrated embodiment, three fingers 34 extend upwardly along medial side 12 and one finger 34 extends upwardly along the front of forefoot portion 16. It is to be appreciated that although forefoot member 30 is shown here as a separate element positioned between midsole 26 and outsole 28, forefoot member 30, in certain preferred embodiments, could be of unitary or one-piece construction with midsole 26 or outsole 28.

Figure 4:
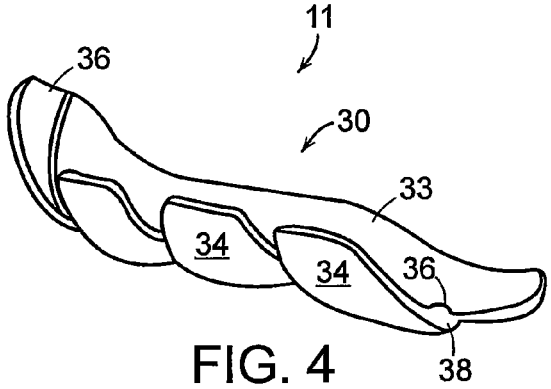
FIG. 4 is a perspective view of a forefoot member of a sole plate of the article of footwear of FIG. 1.

As can be seen in FIG. 4, an interior shoulder 36 is formed at the base of an interior surface of fingers 34. Interior shoulder 36 serves to mate with an upper edge of midsole 26, making a smooth transition between an interior surface of fingers 34 and the upper surface of midsole 26. Similarly, an exterior shoulder 38 is formed at the base of an exterior surface of fingers 34. Exterior shoulder 38 serves to receive outsole 28, such that, when assembled, the exterior surface of each finger 34 at exterior shoulder 38 is substantially flush with the exterior surface of outsole 28.

Fingers 34 of forefoot member 30 serve to provide enhanced resistance to abrasion when the user's toes are dragged, for example, while playing sports such as tennis. Fingers 34 are preferably formed of a wear resistant material. In a preferred embodiment, fingers 34 are formed of thermoplastic polyurethane (TPU). Other suitable materials for fingers 34 will become readily apparent to those skilled in the art, given the benefit of this disclosure. In a preferred embodiment, the exterior surface of fingers 34 may have a polished look, enhancing its aesthetic appeal.

Midfoot member 32 includes a medial member 40 and a lateral member 42. Medial member 40 includes a base plate 44 and at least one medial pillar 46, such as an arch support member 46, extending upwardly from base plate 44 along medial side 12. Arch support member 46 provides support for the arch of the user's foot. Although a single medial pillar 46 is illustrated here, it is to be appreciated that multiple medial pillars 46 may be provided, each of which may be positioned in forefoot portion 16, midfoot portion 18 or heel portion 20 of footwear 10.

Base plate 44 includes a substantially planar finger 48 that extends forwardly to a point just rearwardly of the first and second metatarsal heads of the foot of a user.

A thickened portion 50 extends along an upper surface of base plate 44 along a lateral edge of medial member 40. Thickened portion 50 provides rigidity and stability for medial member 40 of midfoot member 32 and is received in a recess formed in midsole 26 as described in greater detail below. A flange 52 extends inwardly from thickened portion 50 toward lateral side 14.

Lateral member 42 includes a base plate 54 and a plurality of pillars 56 extending upwardly from base plate 54 along lateral side 14 of base plate 54. In the illustrated embodiment, one pillar 56 extends upwardly and rearwardly along lateral side 14 in heel portion 20. A pair of pillars 56 extends upwardly and forwardly along lateral side 14 at the forward edge of midfoot portion 18. Pillars 56 partially surround the lateral member of the user's foot, providing support for the user's foot during lateral movements.

A thickened portion 58 extends along an upper surface on medial side 12 of base plate 54. Thickened portion 58 provides rigidity and stability for lateral member 42 of midfoot member 32 and is received in a recess formed in midsole 26 as described in greater detail below. A flange 60 extends inwardly from thickened portion 58 toward medial side 12. Flange 60 is configured to mate with flange 52 formed on medial member 40. In the illustrated embodiment, flange 60 extends beneath flange 52 such that medial side 12 of thickened portion 58 of lateral member 42 abuts with lateral side 14 of thickened portion 50 of medial member 40. Thickened portions 50, 58 combine to act as a shank, providing rigidity and strength for midfoot member 32 of footwear 10.

Although in the illustrated embodiment, medial member 40 and lateral member 42 are shown as two separate elements, it is to be appreciated that in other preferred embodiments, medial member 40 and lateral member 42 may be of unitary, that is, one-piece, construction. In a preferred embodiment, medial member 40 and lateral member 42 are secured to one another by adhesive, providing an integrated assembly that improves the leverage action provided by pillars 56.

Midfoot member 32 is preferably stiffer and more rigid than forefoot member 30. In a preferred embodiment, midfoot member 32 is formed of thermoplastic polyurethane (TPU), with a higher stiffness or hardness than forefoot member 30. Other suitable materials for fingers 34 will become readily apparent to those skilled in the art, given the benefit of this disclosure. In a preferred embodiment, the exterior surface of fingers 34 may have a polished look, enhancing its aesthetic appeal.

Figure 5:
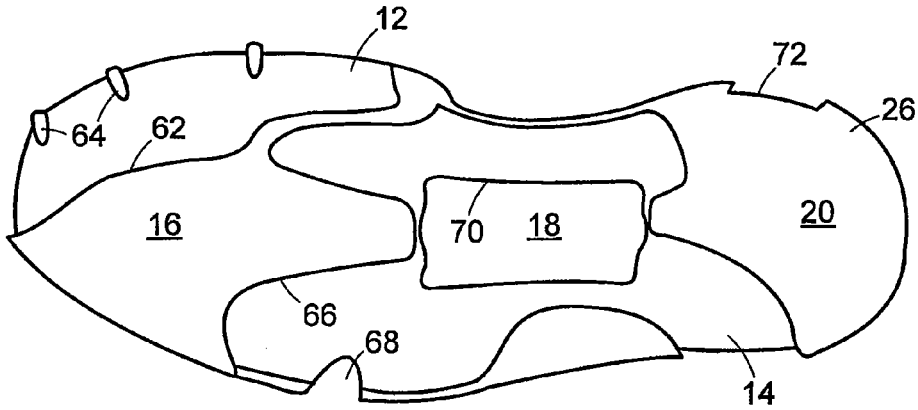
FIG. 5 is a bottom plan view of the midsole of the article of footwear of FIG. 1.
Figure 6:
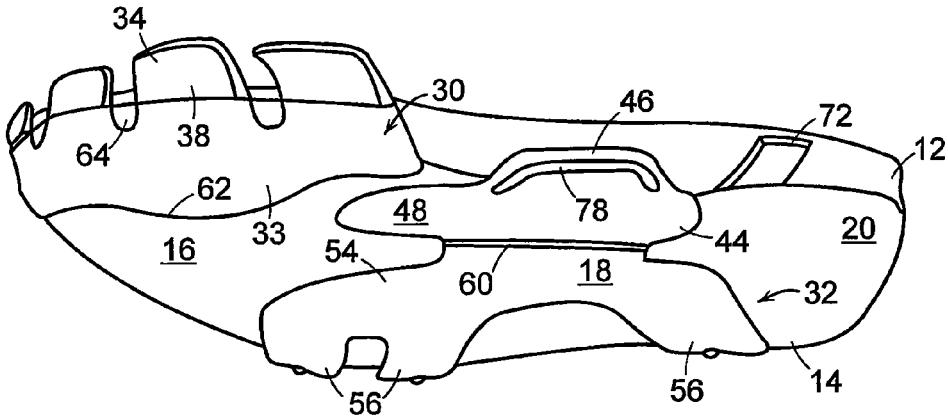
FIG. 6 is a perspective view of the medial side and bottom of the midsole of the article of FIG. 1, shown with the forefoot member and midfoot member secured thereto.

In FIG. 5, the bottom of midsole 26 can be seen. A first forefoot recess 62 is formed in the bottom surface of midsole 26, on medial side 12 of forefoot portion 16. Forefoot recess 62 extends along the bottom of midsole 26 and partially up medial side 12. Forefoot recess 62 serves to receive forefoot member 30 when footwear 10 is assembled, as seen in FIG. 6, providing a mechanical interlocking between fingers 34 and midsole 26. Ridges 64 are formed within forefoot recess 62 along medial side 12 of midsole 26. Ridges 64 are positioned between respective fingers 34 when footwear 10 is assembled.

A second midfoot recess 66 is formed in the bottom of midsole 26, in midfoot portion 18, as seen in FIG. 5. Midfoot recess 66 serves to receive medial member 40 and lateral member 42 of midfoot member 32, as seen FIGS. 6-7 and acts to provide a mechanical engagement between midfoot member 32 and midsole 26. A ridge 68 is formed on the lateral edge of midfoot recess 66, and extends upwardly along lateral side 14 of midsole 26. Ridge 68 is positioned between the pillars 56 of forefoot portion 16 when footwear 10 is assembled.

A third central recess 70 is formed in the bottom of midsole 26 within midfoot recess 66 and serves to receive thickened portions 50, 58 of medial member 40 and lateral member 42 of midfoot member 32, respectively. The interlocking of the peripheral edges of thickened portions 50, 58 and the wall of central recess 70 serves to supplement the mechanical engagement between midfoot member 32 and midsole 26.

A fourth heel recess 72 is formed in medial side 12 of heel portion 20. Recess 72 serves to receive a finger 74 extending upwardly and rearwardly from outsole 28, as seen in FIG. 1.

During assembly, flange 52 of medial member 40 may be adhesively secured to flange 60 of lateral member 42. The elements of sole plate 11 are preferably adhesively secured to midsole 26 with a cement or other suitable adhesive. Outsole 28 is then adhesively secured to the bottom surface of midsole 26 and the exposed portions of sole plate 11.

Figure 7:
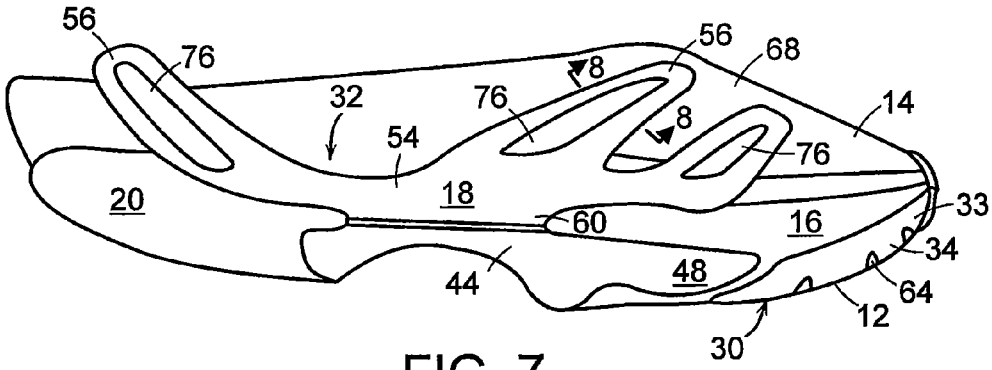
FIG. 7 is a perspective view of the lateral side and bottom of the midsole of the article of FIG. 1, shown with the forefoot member and midfoot member secured thereto.
Figure 8:
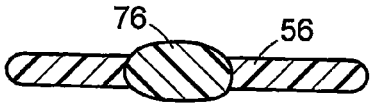
FIG. 8 is a section view, taken along line 8-8 of FIG. 7, showing a pillar of the midfoot member of FIG. 7.

In certain preferred embodiments, as seen in FIGS. 7-8, pillars 56 include a central core 76 extending along a portion of the length of pillars 56. Central core 76 is formed of a material having a greater strength and rigidity than the remainder of pillars 56. In a preferred embodiment, pillars 56 and core 76 are co-molded. Central core 76 may also be TPU, with a higher hardness than the material of pillar 56. Central core 76 provides a larger thickness in the central portion of pillar 56, essentially providing a rib along the interior and exterior surfaces of pillar 56.

Similarly, as seen in FIG. 6, a rib 78 may be formed in arch support member 46 proximate its upper edge. Rib 78 adds rigidity and strength to arch support member 46. In a preferred embodiment, rib 78 has a construction similar to that of central core 76 described above.

In certain preferred embodiments, pillars 56 may have a ridge 57 extending along their exterior surface, as seen in FIG. 5, providing rigidity and stability for pillars 56.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

a sole assembly;

an upper secured to the sole assembly;

a sole plate positioned within the sole assembly, the sole plate comprising a midfoot member comprising a medial member having a base plate and at least one medial pillar extending upwardly from a medial edge of the base plate, the base plate having a substantially planar finger extending forwardly and configured to extend under a foot of a user; and a lateral member having at least one lateral pillar extending upwardly from a lateral edge thereof; and a forefoot member having at least one finger extending upwardly along an exterior surface of the upper;

wherein the sole plate includes a thickened portion along at least one a medial edge of the lateral member and a lateral edge of the medial member.

2. The article of footwear of claim 1, wherein the medial member and lateral member of the midfoot member are separate elements.

3. The article of footwear of claim 1, wherein the medial member and lateral member of the midfoot member are of unitary construction.

4. The article of footwear of claim 1, wherein the lateral member has two pillars extending upwardly and forwardly in a forefoot portion thereof.

5. The article of footwear of claim 1, wherein the lateral member has one pillar extending upwardly and rearwardly in a heel portion thereof.

6. The article of footwear of claim 1, wherein a central core of a material having a hardness greater than that of the remainder of the pillar is formed along a portion of the length of each pillar.

7. The article of footwear of claim 6, wherein the central core forms a rib along an interior and exterior surface of the pillar.

8. The article of footwear of claim 1, wherein a rib is formed proximate an upper edge of the arch portion, the rib having a hardness greater than that of the remainder of the arch portion.

9. The article of footwear of claim 8, wherein the rib extends along an interior and exterior surface of the arch portion.

10. The article of footwear of claim 1, wherein the midfoot member has a hardness greater than a hardness of the forefoot member.

11. The article of footwear of claim 1, wherein the lateral member of the midfoot member includes a thickened portion along a medial edge thereof.

12. The article of footwear of claim 11, further comprising a flange extending inwardly from the thickened portion.

13. The article of footwear of claim 12, wherein the medial member of the midfoot member includes a thickened portion along a lateral edge thereof.

14. The article of footwear of claim 13, further comprising a flange extending inwardly from the thickened portion.

15. The article of footwear of claim 14, wherein the flange of the medial member is configured to mate with the flange of the lateral portion.

16. The article of footwear of claim 1, wherein the forefoot member includes three fingers extending upwardly from a medial edge thereof and a finger extending upwardly from a front edge thereof.

17. The article of footwear of claim 1, further including a first shoulder formed at a base of an interior surface of each finger in the forefoot member and a second shoulder formed at a base of an exterior surface of each finger in the forefoot member.

18. The article of footwear of claim 1, wherein the sole plate is formed of thermal polyurethane.

19. The article of footwear of claim 1, wherein the sole assembly includes a midsole and a lower surface of the midsole includes a forefoot recess configured to receive the forefoot member.

20. The article of footwear of claim 19, wherein the forefoot recess defines a plurality of ridges, each ridge positioned between adjacent fingers of the forefoot member.

21. The article of footwear of claim 1, wherein the sole assembly includes a midsole and a lower surface of the midsole includes a midfoot recess configured to receive the midfoot member.

22. The article of footwear of claim 21, wherein a central recess is formed within the midfoot recess, the central recess configured to received a thickened portion formed on an upper surface of each of the medial and lateral portions of the midfoot member.

23. The article of footwear of claim 1, wherein the medial member is secured to the lateral member with an adhesive.

24. The article of footwear of claim 1, wherein the sole assembly includes a midsole and the sole plate is secured to the midsole with an adhesive.

25. The article of footwear of claim 1, wherein the outsole is secured to the midsole with an adhesive.

26. The article of footwear of claim 1, wherein a heel recess is formed in medial side of a heel portion of the midsole.

27. The article of footwear of claim 26, wherein the outsole includes a finger extending upwardly and rearwardly and received in the heel recess.

28. The article of footwear of claim 1, wherein the sole assembly comprises a midsole secured to the upper and an outsolesecured to the midsole.

29. The article of footwear of claim 28, wherein the sole plate is positioned between the midsole and the outsole.

30. The article of footwear of claim 28, wherein the sole plate is positioned between the midsole and the upper.

31. The article of footwear of claim 1, wherein the at least one medial pillar comprises an arch support member.

32. The article of footwear of claim 1, wherein the substantially planar finger is configured to extend to a point just rearwardly of the first and second metatarsal heads of a user's foot.

33. The article of footwear of claim 1, wherein the forefoot member is of unitary construction with the sole assembly.

34. An article of footwear comprising, in combination:

an upper;

a midsole secured to the upper;

an outsole secured to the midsole;

a sole plate positioned between the midsole and the outsole, the sole plate comprising a midfoot member comprising a medial member having a base plate and an arch portion extending upwardly from the base plate, the base plate having a substantially planar finger extending forwardly and configured to extend to a point just rearwardly of the first and second metatarsal heads of a foot of a user; and a lateral member having a pair of pillars extending upwardly and forwardly along a lateral edge of a forefoot portion of the lateral member, and a pillar extending upwardly and rearwardly along a lateral edge of a heel portion of the lateral member; and a forefoot member having three fingers extending upwardly from a medial edge thereof along an exterior surface of the upper and a finger extending upwardly from a front edge thereof along the exterior surface of the upper.

35. An article of footwear comprising, in combination:

an upper;

a midsole secured to the upper, a bottom surface of the midsole including a forefoot recess, a midfoot recess and a central recess, the central recess formed within the midfoot recess;

an outsole secured to the midsole;

a sole plate positioned between the midsole and the outsole, the sole plate comprising a midfoot member received by the midfoot recess and comprising a medial member having a base plate and an arch portion extending upwardly from the base plate, the base plate having a substantially planar finger extending forwardly and configured to extend to a point just rearwardly of the first and second metatarsal heads of a foot of a user, and a thickened portion along a lateral edge thereof, a flange extending inwardly from the thickened portion; and a lateral member having a pair of pillars extending upwardly and forwardly along a lateral edge of a forefoot portion of the lateral member, and a pillar extending upwardly and rearwardly along a lateral edge of a heel portion of the lateral member, and a thickened portion along a medial edge thereof, a flange extending inwardly from the thickened portion, the flange of the lateral member configured to mate with the flange of the medial member, the thickened portion of the lateral member and the thickened portion of the medial member received by the central recess; and a forefoot member having three fingers extending upwardly along a medial exterior surface of the upper and a finger extending upwardly along a front exterior surface of the upper.

* * * * *

UNITED STATES PATENT AND TRADEMARK OFFICE

CERTIFICATE OF CORRECTION

PATENT NO. : 7,299,567 B2
APPLICATION NO. : 10/870674
DATED : November 27, 2007
INVENTOR(S) : Thomas Berend et al.

It is certified that error appears in the above-identified patent and that said Letters Patent is hereby corrected as shown below:

Column 6, line 36, replace “a medial” with --medial--.

Column 37, line 49, replace “medial” with --a medial--.

Signed and Sealed this

Eighth Day of July, 2008

JON W. DUDAS
*Director of the United States Patent and Trademark Office*